US006276530B1

(12) United States Patent
Bailey

(10) Patent No.: US 6,276,530 B1
(45) Date of Patent: Aug. 21, 2001

(54) CONTAINER

(75) Inventor: Mark William Bailey, Walsall (GB)

(73) Assignee: McKenzie Components Limited, West Midlands (GB)

( * ) Notice: Subject to any disclaimer, the term of this patent is extended or adjusted under 35 U.S.C. 154(b) by 0 days.

(21) Appl. No.: 09/471,954

(22) Filed: Dec. 23, 1999

(30) Foreign Application Priority Data

Dec. 23, 1998 (GB) ..... 9828413

(51) Int. Cl.[7] ..... B65D 21/04
(52) U.S. Cl. ..... 206/519; 206/520; 206/506
(58) Field of Search ..... 206/508, 505, 206/506, 511, 518, 519, 520, 516; 220/326

(56) References Cited

U.S. PATENT DOCUMENTS

| | | | | |
|---|---|---|---|---|
| 3,375,953 | * | 4/1968 | Miller . | |
| 4,572,374 | * | 2/1986 | Sirotkin | 206/518 |
| 4,720,013 | * | 1/1988 | Nichols et al. | 206/506 |
| 4,760,784 | * | 8/1988 | Whiteside | 100/220 |
| 5,335,789 | * | 8/1994 | Taravella et al. | 206/518 |
| 5,360,114 | * | 11/1994 | Weidt | 206/506 |
| 6,089,373 | * | 7/2000 | Cope | 206/505 |

FOREIGN PATENT DOCUMENTS

| | | |
|---|---|---|
| 0 565 388 A2 | 10/1993 | (EP) . |
| 2 311 276 | 9/1997 | (GB) . |
| 2 325 663 | 12/1998 | (GB) . |
| WO 98/04467 A1 | 2/1998 | (WO) . |

* cited by examiner

*Primary Examiner*—Stephen Castellano
(74) *Attorney, Agent, or Firm*—Adams, Schwartz & Evans, P.A.

(57) ABSTRACT

A container 10 comprises walls 12 which are upstanding from a base 14 to define a space 16 within which items may be placed, such as for transportation or storage. The walls 12 are sloped to allow the container 10 to nest with a like container. The container 10 further comprises filler members 18 locatable within the space 16 at positions fixed relative to the walls 12. When so located, the fillers 18 define, in use, a substantially vertical boundary to the said space.

15 Claims, 3 Drawing Sheets

CONTAINER

TECHNICAL FIELD AND BACKGROUND OF THE INVENTION

The present invention relates to containers, and particularly, but nor exclusively, to containers for use in delivering goods to retail premises.

Goods being dispatched to retail premises are conventionally packed into reusable containers, boxes or crates which can be stacked on each other during transportation and storage. In order to facilitate return transportation when empty, it is conventional to design the containers to be nestable one within the other, so that a large number of empty containers can be stored or transported in a compact manner. Nesting is conventionally achieved by providing side walls which slant or slope up to the upper mouth of the container, so that the base of another container can be received partially into an empty container below. However, the slanting nature of the walls can give rise to packing problems, particularly in relation to goods which are packed in parallelepipedal packaging. The slanting of the walls means that lateral movement of the goods may not be adequately prevented, giving rise to the risk of damage, particularly during transit.

SUMMARY OF THE INVENTION

The present invention provides a container comprising walls upstanding from a base to define a space within which items may be placed, the walls being sloped to allow the container to nest within a like container, and the container further comprising at least one filler member locatable within the space at a position fixed relative to one of the walls, the filler member, when so located, defining a substantially vertical boundary to the said space.

The filler member may be releasably fixed as aforesaid. The filler member is preferably movable away from the said fixed position, to allow nesting. The filler member may be attached to the container, and movable to or away from the fixed position. The filler member is preferably hingedly attached to the container.

The filler member may be attached to hinge down to the base when moving away from the fixed position. The filler member is preferably hingedly attached to the container along a lower edge of the filler member.

Alternatively, the filler member may be attached to hinge out of the container space. The filler member may be attached to hinge out to a position alongside the outer surface of the container. The filler member may be hingedly attached to the container along an upper edge of the filler member.

Preferably a plurality of filler members are provided. Each wall of the container preferably has an associated filler member.

The container preferably further comprises lid means attachable to the container to close the container space from above. The lid means may be adjustably attachable to allow the sides of the container space to be altered. The lid means may be attachable by means of a line of slots, and a tab movable into a selectable one of the slots to be retained thereby. The slot means may comprise a line of retention slots connected by a connection slot along which the tab is movable between retention slots. There may be a plurality of attachment means as aforesaid. Preferably, attachment means as aforesaid are provided to attach the lid means in the region of each corner of the container. The attachment means may be provided, in part by the filler member.

BRIEF DESCRIPTION OF THE DRAWINGS

Embodiments of the present invention will now be described in more detail by way of example only, and with reference to the accompanying drawings, in which.

DESCRIPTION OF THE PREFERRED EMBODIMENT AND BEST MODE

Figure 1:
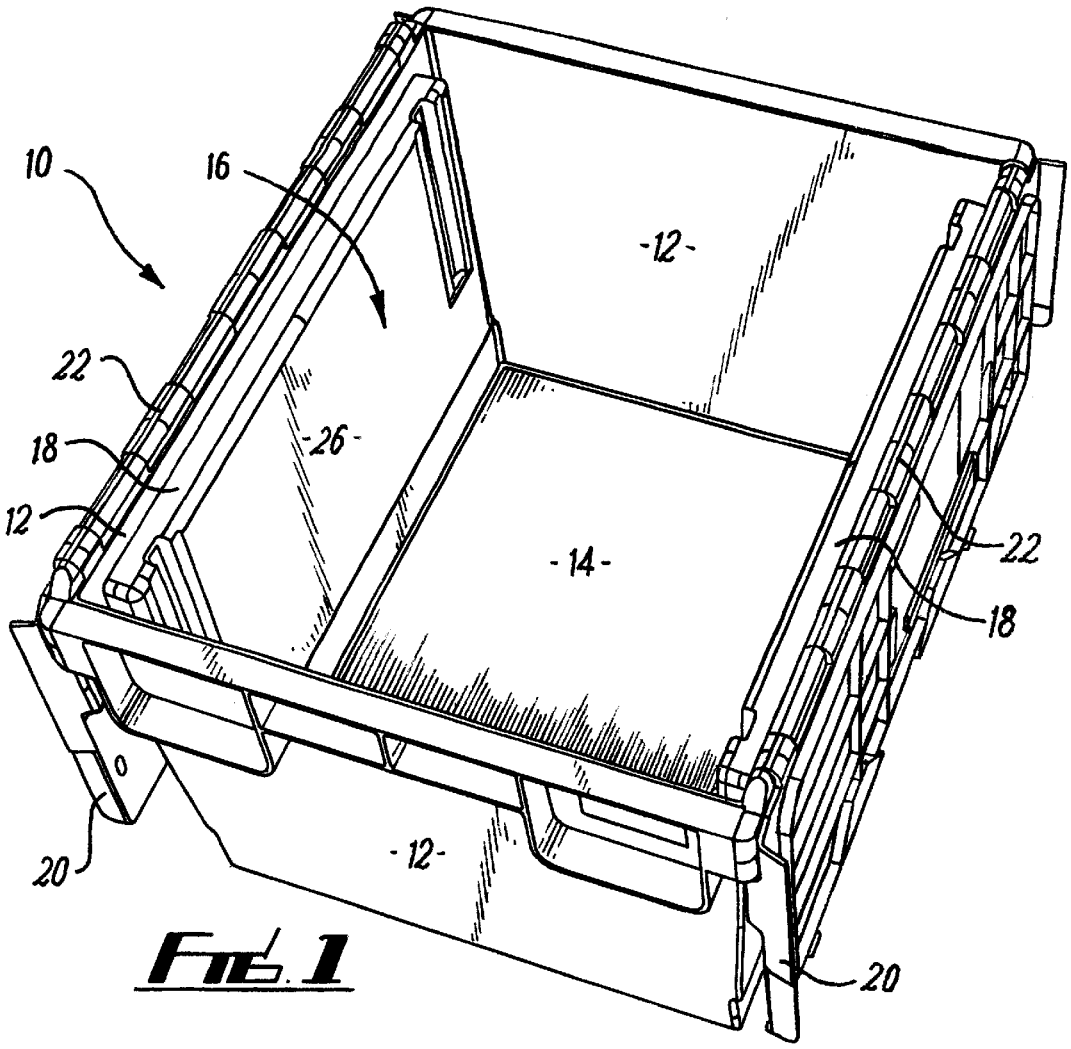
FIG. 1 is a perspective view of a container according to the present invention, with the lid open and fillers in position.

FIG. 1 shows a container 10 comprising walls 12 which are upstanding from a base 14 to define a space 16 within which items (not shown) may be placed, such as for transportation or storage. The walls 12 are sloped (FIG. 2) to allow the container 10 to nest with a like container. The container 10 further comprises filler members 18 locatable within the space 16 at positions fixed relative to the walls 12. When so located, the fillers 18 define, in use, a substantially vertical boundary to the said space.

The container 10 is also provided with two leaves 20 of a lid, hinged at 22 along the upper edge of two opposed walls 12, so that the leaves 20 can hang down outside the container 10 (as shown in FIG. 1) or can swing over the top of the container, to dose the space 16.

Figure 2:
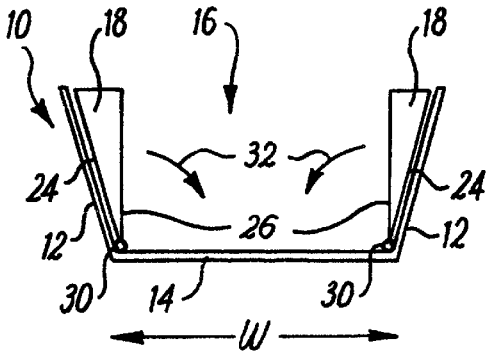
FIG. 2 is a highly schematic vertical section through the container of FIG. 1 with the lid removed.

The walls 12 slope up from the base 14, to lean outwardly, as can be seen in FIG. 2. Consequently, the width W of the container increases from the width of the base 14, up to the width of the upper mouth of the container 10. It can therefore readily be understood that the walls 12 cannot themselves retain items against lateral movement to the same degree near the top of the container, as they can near the base 14, because of this increased width.

FIG. 2 shows two fillers 18 provided in accordance with the invention, adjacent opposed walls 12. In the simple arrangement illustrated, each filler extends up the inside face of the corresponding wall 12, and becomes progressively thicker. Appropriate choice of angles and dimensions for the filler 18 allows the filler to be positioned as shown in FIG. 2, with an outer surface 24 closely adjacent the inner face of the corresponding wall 12, and an inner surface 26 facing into the space 16 and being substantially vertical. Thus, with two opposed fillers 18 located as illustrated in FIG. 2, the space 16 is converted into a vertical sided space, within which articles can be held against lateral movement to the same extent at any height above the base 14.

It will be readily apparent that in order to achieve this, the filler 18 could provide a continuous vertical surface, or a broken surface (such as ribs, a mesh or the like), either alternative serving to define a substantially vertical boundary to the space 16.

The fillers 18 are attached by hinges 30 to the base 14 along their lower edge, so that when in the positions shown in FIG. 2, the fillers 18 (and their surfaces 26) will be in a fixed position relative to the corresponding wall 12. However, the hinges 30 allow the fillers 18 to fold down over the base 14, within the container 10, to the position shown in FIG. 3. This exposes again the sloping inner surfaces of the walls 12, so that the container 10 can again be nested with a like container introduced from above. Once the containers are fully nested, the folded down fillers 18 will be contained within the space between the bases of the nested containers.

Figure 3:
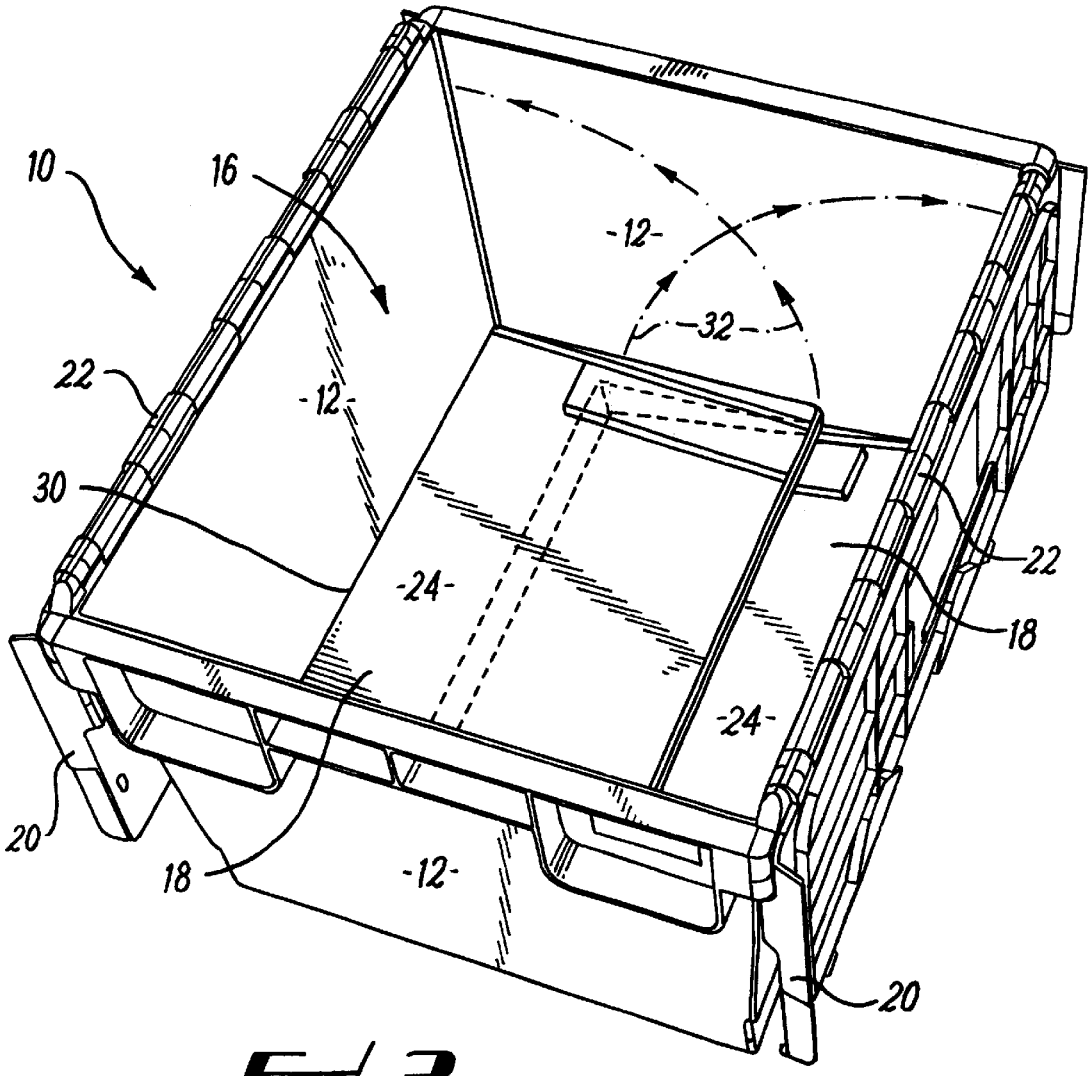
FIG. 3 is a view corresponding to FIG. 1, showing the fillers lowered to their out of use position.

FIGS. 2 and 3 show arrows 32 which illustrate how the upper edges of the fillers 18 move between the folded down position (FIG. 3) up to the position for use (FIGS. 1 and 2).

Figure 4:
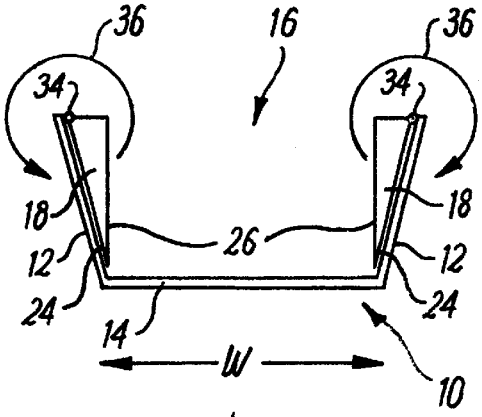
FIG. 4 is a view corresponding with FIG. 2, showing an alternative arrangement.

FIG. 4 illustrates schematically another alternative arrangement for the fillers 18. In this alternative, each filler 18 is attached to the upper edge of a wall 12, along the upper edge of the filler 18, by hinges 34. The hinges 34 allow the fillers 18 to be removed from the space 16 by hinging to raise the lower edges of the fillers 18, swinging them out over the wall 12, until the fillers 18 hang down outside the container 10 (in a position similar to the hanging leaves 20 illustrated in FIG. 1). This movement is illustrated in FIG. 4 by arrows 36. Again, the effect is to expose the sloping walls 12, to allow nesting of like containers.

The alternative illustrated in FIG. 4 may be particularly advantageous in a situation where the container 10 is not required to have a lid, so that there are no lid leaves 20.

Figure 5:
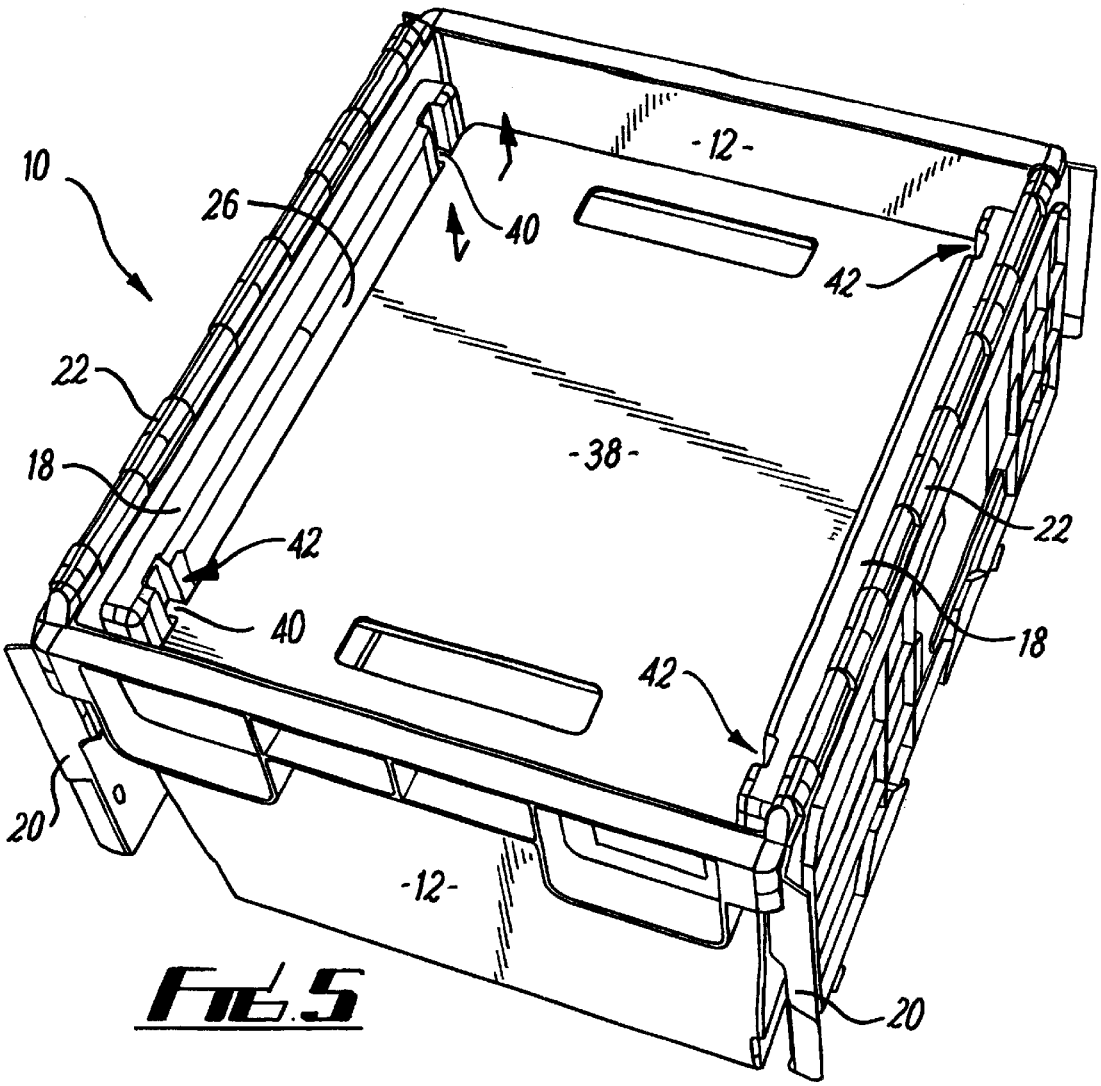
FIG. 5 is a perspective view showing a lid arrangement for the container of FIG. 1.
Figure 6:
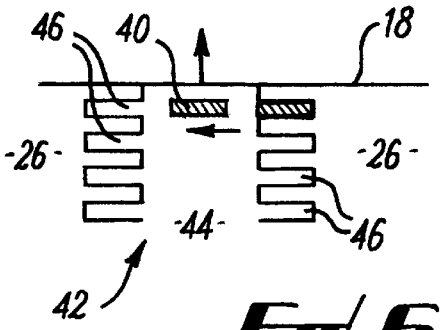
FIG. 6 is a highly schematic diagram illustrating the manner in which a packing lid can be attached and adjusted on the container of FIG. 5.

FIGS. 5 and 6 illustrate arrangements for providing the container with a packing lid 38 which can be moved down onto goods within the container 10, to help hold those goods during transit, but can readily be removed when access to the container 10 is required. The lid 38 consists of a generally planar member which is provided at or near each corner with a small tab 40. Each of these tabs 40 can cooperate with slot arrangements 42 in the vertical faces of the fillers 18. Each slot arrangement 42 consists of a central connection slot 44, which runs generally vertically and from which extend sideways a large number of generally horizontal retention slots 46. This arrangement is illustrated schematically in FIG. 6, which shows in cross-section the tab 40, which is of an appropriate size to be received in any selected retention slot 46, so that vertical movement of the lid 38 in either direction is prevented. However, the tab 40 can slide from the retention slot 46 into the connection slot 44, whereupon vertical movement of the lid 38 then becomes possible again, allowing the lid 38 to be raised or lowered to a new position, and then slid laterally to engage each tab 40 with a corresponding retention slot 46 at the new height. Consequently, by simple sideways movement, the lid 38 can be freed for vertical movement, allowing the lid 38 to be pressed down onto goods within the container 10, to hold those goods, the lid 38 thereafter being locked in position by engagement of the tabs 40 and slots 46.

It will be apparent that many variations and modifications can be made to the apparatus described above, without departing from the scope of the invention. In particular, dimensions and relative dimensions can be widely varied. The form of one attachment between the lid 38 and the fillers 18 can be altered, or the lid 38 may be dispensed with. The fillers 18 are preferably permanently attached to the container 10, but could alternatively be removable when not in use. Fillers may be provided for all walls of the container, or for only some of them. Components of the container can be manufactured from many different materials, but injection moulding from a plastics material is envisaged.

Various references have been made to "vertical", "up", "down" and the like. These references are made because containers for many uses, including retail uses, are usually required to have an open top, a generally horizontal base, and upstanding walls. Stacks will generally be vertical for stability. Consequently, inside boundaries which are perpendicular to the base, as provided by the fillers, will be vertical. However, it will be readily understood that the same principles of the invention could be applied with other orientations, if required for a particular purpose.

Whilst endeavouring in the foregoing specification to draw attention to those features of the invention believed to be of particular importance it should be understood that the applicant claims protection in respect of any patentable feature or combination of features hereinbefore referred to and/or shown in the drawings whether or not particular emphasis has been placed thereon,

What is claimed is:

1. A container comprising walls upstanding from a base to define a space within which items may be placed and having means attachable to the container to close the space from above, said means to close being adjustably attachable to allow the size of the container space to be altered, and the walls being sloped to allow the container to nest within a like container, and the container further comprising at least one filler member attached to the container to be movable within the space to or away from a position fixed relative to one of the walls, the filler member, when located at the fixed position, defining a substantially vertical boundary to the space.

2. A container according to claim 1, wherein the filler member is releasably fixable at the said position.

3. A container according to claim 2, wherein the filler member is movable away from the said fixed position, to allow nesting.

4. A container according to claim 2, wherein the filler member is hingedly attached to the container.

5. A container according to claim 4, wherein the filler member is attached to hinge down to the base when moving away from the fixed position.

6. A container according to claim 4, wherein the filler member is hingedly attached to the container along a lower edge of the filler member.

7. A container according to claim 4, wherein the filler member is attached to hinge out of the container space.

8. A container according to claim 7, wherein the filler member is attached to hinge out to a position alongside the outer surface of the container.

9. A container according to claim 7, wherein the filler member is hingedly attached to the container along an upper edge of the filler member.

10. A container according to claim 1, wherein a plurality of filler members are provided.

11. A container according to claim 1, wherein the means to close is attachable by a line of slots, and a tab movable into a selectable one of the slots to be retained thereby.

12. A container according to claim 11, wherein the line of slots comprise a line of retention slots connected by a connection slot along which the tab is movable between retention slots.

13. A container according to claim 11, and comprising a plurality of means operable to attach the lid means as aforesaid.

14. A container according to claim 13, wherein the means for attaching are provided to attach the means for closing in the region of each corner of the container.

15. A container according to claim 11, wherein the means for attaching are provided, in part, by the filler member.

* * * * *

UNITED STATES PATENT AND TRADEMARK OFFICE

CERTIFICATE OF CORRECTION

PATENT NO. : 6,276,530 B1
DATED : August 21, 2001
INVENTOR(S) : Bailey, Mark William It is certified that error appears in the above-identified patent and that said Letters Patent is hereby corrected as shown below:

Title page,
Item [73] Assignee, the Assignee's name should read -- McKechnie Components Limited -- instead of "McKenzie Components Limited".

Signed and Sealed this

Fifth Day of March, 2002

*Attest:*

*Attesting Officer*

JAMES E. ROGAN
*Director of the United States Patent and Trademark Office*